United States Patent [19]

Canton et al.

[11] Patent Number: 4,649,379

[45] Date of Patent: Mar. 10, 1987

[54] DATA DISPLAY APPARATUS WITH CHARACTER REFRESH BUFFER AND ROW BUFFERS

[75] Inventors: David A. Canton, Romsey; Brian L. Holloway, Winchester; Nicholas B. Sargeant, Eastleigh; Roger J. Llewelyn, Winchester, all of England

[73] Assignee: International Business Machines Corp., Armonk, N.Y.

[21] Appl. No.: 656,105

[22] Filed: Sep. 28, 1984

[30] Foreign Application Priority Data

Sep. 28, 1983 [EP] European Pat. Off. ..... 83305854.8

[51] Int. Cl.[4] ..... G09G 1/16

[52] U.S. Cl. ..... 340/750; 340/748; 340/799; 340/731

[58] Field of Search ..... 340/750, 747, 744, 748, 340/723, 726, 802, 731, 732, 720

[56] References Cited

U.S. PATENT DOCUMENTS

| | | | |
|---|---|---|---|
| 3,641,559 | 2/1972 | Hogan et al. | 340/717 |
| 4,278,973 | 7/1981 | Hughes et al. | 340/721 |
| 4,284,989 | 8/1981 | Parsons | 340/750 |
| 4,298,931 | 11/1981 | Tachiuchi et al. | 364/200 |
| 4,399,435 | 8/1983 | Urabe | 340/750 |
| 4,437,093 | 3/1984 | Bradley | 340/726 |
| 4,489,317 | 12/1984 | Shiga | 340/726 |

FOREIGN PATENT DOCUMENTS 0058011 8/1982 European Pat. Off. .

OTHER PUBLICATIONS

IBM Technical Disclosure Bulletin, Dec. 1980, p. 2897, vol. 23, No. 74; W. J. Nestork et al., "Buffer System for Data Display".

*Primary Examiner*—Gerald L. Brigance
*Attorney, Agent, or Firm*—Frederick D. Poag

[57] ABSTRACT

A data display apparatus employs a raster scan cathode ray tube (1), a character refresh buffer (2) and three character row buffers (5,6,15) to address a character generator (3) in conjunction with a slice counter (4) or offset slice counter (18) under control of an events control module (20). This enables data within a partition on the CRT to be scrolled smoothly (scan-line-by-scan-line) and characters of different height (requiring different numbers of scans) to be displayed on the same row of the CRT.

5 Claims, 4 Drawing Figures

DATA DISPLAY APPARATUS WITH CHARACTER REFRESH BUFFER AND ROW BUFFERS

This invention relates to a data display apparatus with a refresh buffer and row buffers.

Alphanumeric display systems using refreshed cathode ray tubes (CRTs) such as the IBM 8775 display station are well known. Typically such displays include a display refresh buffer (sometimes called the message buffer) which is used to address a character generator, consisting of read only storage (ROS) and/or random access memory (RAM), to obtain a bit pattern for the CRT. As well as displaying alphanumeric characters, other programmable symbols can also be displayed to build up a so-called character graphics picture on the CRT screen.

Because of timing constraints, such displays commonly use two row buffers between the refresh buffer and the character generator. As one of these row buffers is being used to address the character generator, the other is being loaded with codes for the next row. Although these row buffers are sometimes called "line" buffers, within this specification they will be referred to as row buffers. The notation row is used in the sense of a row of characters: the notation line is used to refer to a raster scan line. Thus a row of characters is built up from a number of raster lines which may be thought of as character slices.

European patent specification EP-A-0,009,593 (U.S. Pat. No 4,278,973) describes various aspects of such a typical refreshed alphanumeric display system in which partitions can be created on the CRT screen.

The IBM Technical Disclosure Bulletin, Dec. 1980, pages 2897 and 2898, describes a data display which employs 4 buffers, each capable of storing one quarter of the display screen contents. Normally the system would use each buffer to store ¼ of the the display but in an alternative arrangement the contents of each buffer can be expanded to occupy more of the screen that ¼. However these buffers are quite different to the row buffers referenced above which are used to assemble complete rows of characters.

An object of the present invention is to provide a data display apparatus employing three row buffers instead of the normal two. By this means, smooth scrolling of data within a partition on the CRT screen can be accomplished. In addition, where the display system is controlled by a microprocessor, or other form of logic, the third row buffer can be used to display characters of different height or with subscripts and/or superscripts.

According to the invention, a data display apparatus for displaying data on the screen of a raster-scanned cathode ray tube comprises a refresh buffer adapted to contain character codes representing alphanumeric characters or other symbols to be displayed, a character generator adapted to contain bit patterns corresponding to said characters or symbols to be supplied to said cathode ray tube, a pair of character row buffers for storing successive rows of characters or symbols to be displayed on said cathode ray tube, and means for loading character codes into each row buffer as the other row buffer is accessing said character generator, and is characterized in that a third row buffer, and means for causing any two of the row buffers to access the character generator while the third is being loaded from the refresh buffer whereby the bit pattern for a particular raster scan line can be derived by accessing said character generator by one or two of said row buffers.

The invention will now be described, by way of example, with reference to the accompanying drawings, in which.

Figure 1:
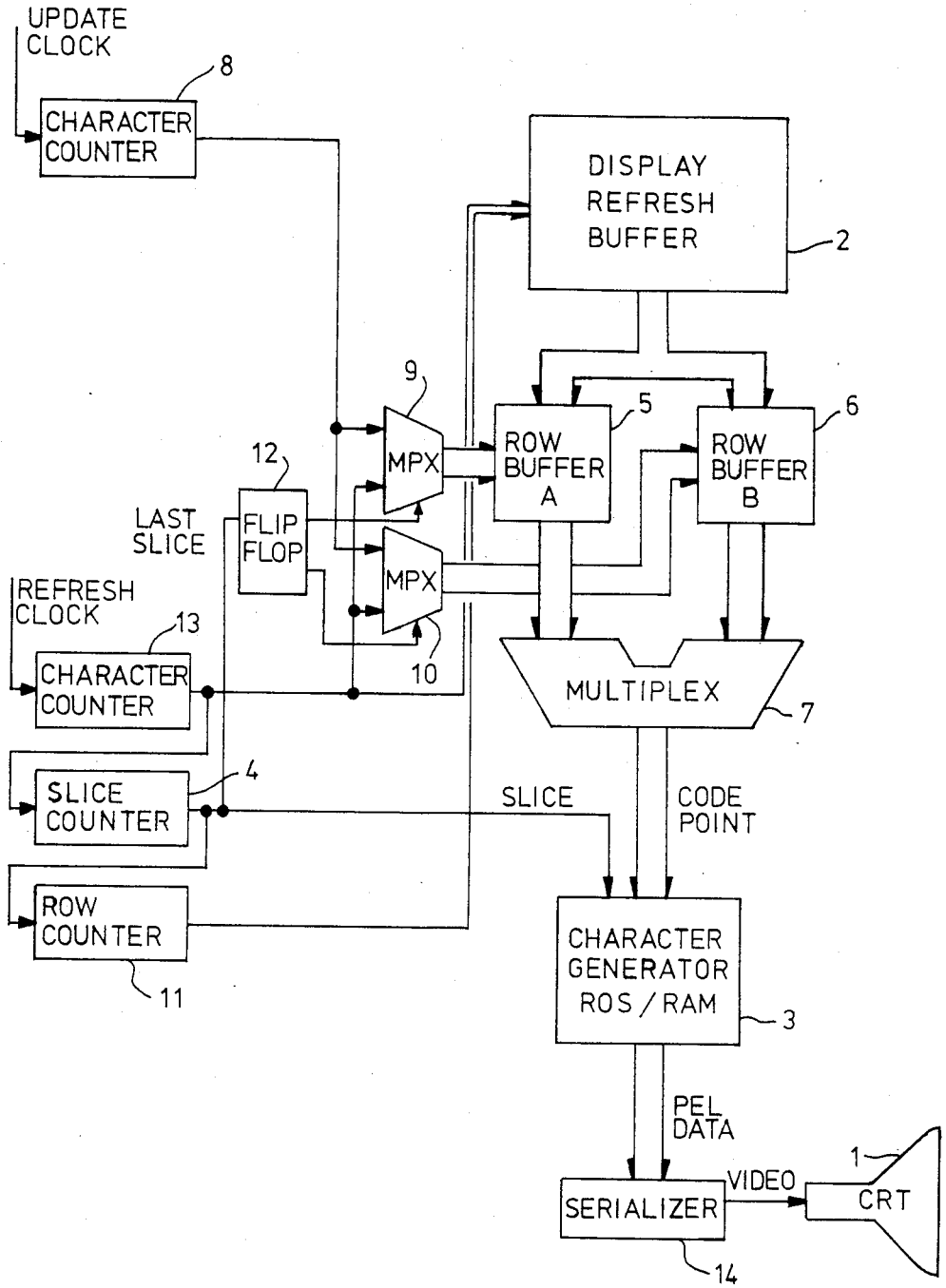
FIG 1 (PRIOR ART)
FIG. 1 shows a prior art display system employing two row buffers.

Referring now to FIG. 1, a typical prior art display system includes a cathode ray tube 1 and in which data to be displayed is stored in a mapped refresh buffer 2. Refresh buffer 2 contains character codes which are used to address a character generator 3 which contains the actual bit patterns required to display the characters or symbols represented by the codes on the CRT 1. The character generator 3 need only consist of Read Only Storage (ROS) for cheapness although nowadays it is normal to include at least some random access memory (RAM) to allow different bit patterns to be loaded into the character generator 3, thus increasing the versatility of the display. Because each character bit pattern within the character generator 3 needs to be addressed a number of times (equal in number to the number of scan lines in a character row) to display the corresponding character, slice counter 4 is also used to address the character generator 3 as well as the code from the buffer 2. The buffer 2 is loaded with character codes under control from a system microprocessor or other control logic (not shown).

Because of speed restraints, it is necessary to use two row buffers A and B, 5 and 6, to address the character generator 3. To this end, row buffer A will address the character generator 3 through multiplexor 7 while row buffer B is loaded from the refresh buffer 2. Similarly after row buffer A has addressed character generator 3, the row buffer B will be used to access the bit patterns for the next row of characters while row buffer A is loaded with new character codes for the next row and so on.

The row buffers A and B are loaded character by character under control of character counter 8 operating through multiplexors 9 and 10 and row counter 11. Selection of multiplexors 9 and 10 is by means of flip-flop 12 which is provided with an input from the slice counter 4 whenever the latter indicates the last slice of a row has accessed character generator 3. Character counter 13 controls the access of character codes from the row buffers A and B during refresh. The picture element (pel) data received in parallel from character generator 3 is serialized in serializer 14 for supply as serial video information to the CRT 1.

Since such a display is well known, no further detail is deemed necessary other than to comment that although a mapped refresh buffer has been shown, an unmapped buffer arrangement could also be used. The only difference would be in the addressing of the refresh buffer 2 during updating of the row buffers A and B.

Figure 2:
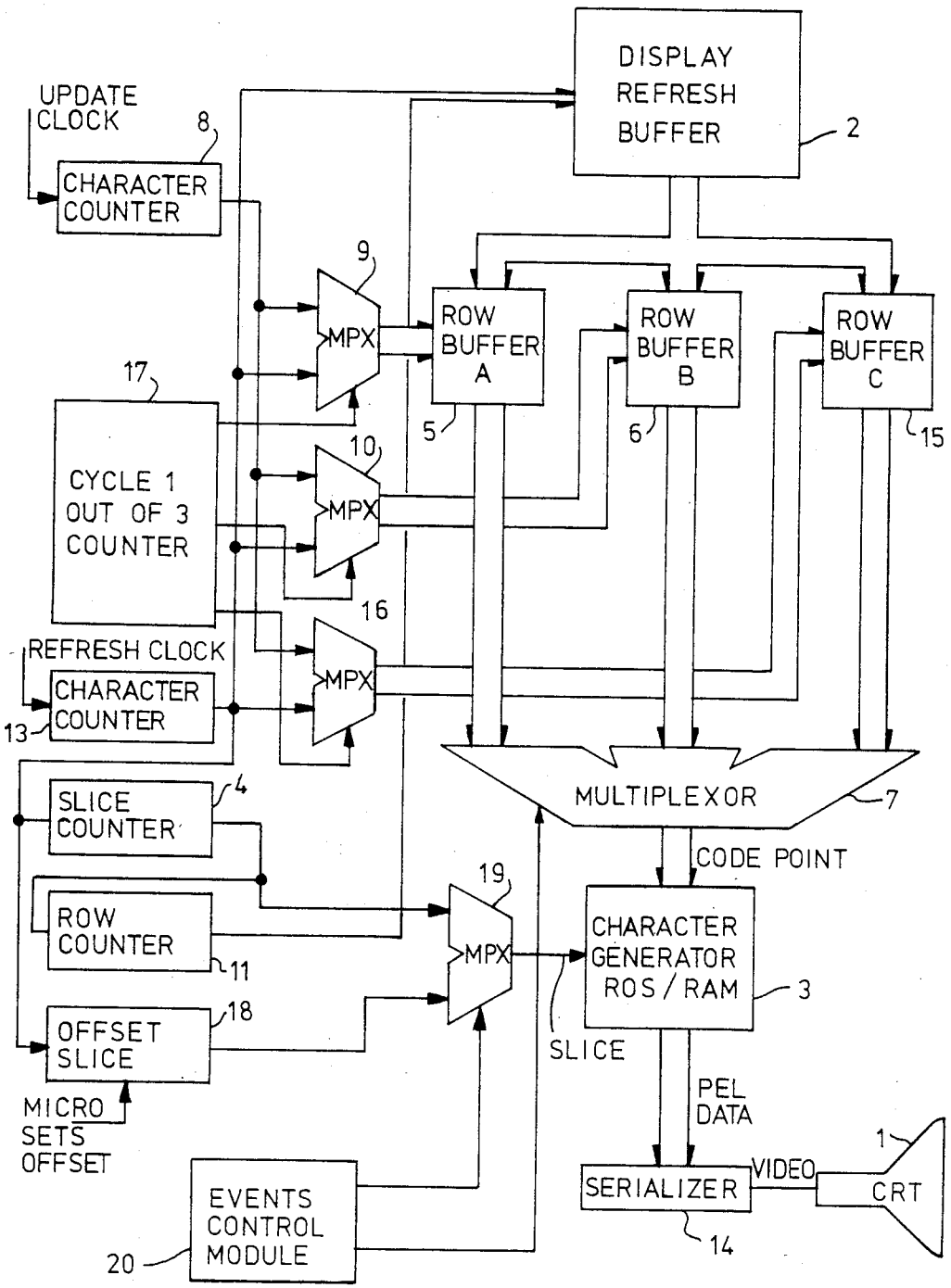
FIG. 2 shows a display system which, in accordance with the invention, has a third row buffer.

FIG. 2 shows a 3 buffer arrangement in accordance with the present invention. Similar parts are given the same reference numerals as were used in FIG. 1. In addition however, a third row buffer C, 15, controlled through a multiplexor 16 has been added. Instead of the flip-flop 12, FIG. 1, the multiplexors 9, 10 and 16 are controlled by a 1 out of 3 counter 17. The outputs of the slice counter 4 and an offset slice counter 18 are applied to the character generator 3 through a multiplexor 19 which, together with multiplexor 7 is controlled by a control module 20.

Operation of the various parts of the display system shown in FIG. 2, and in particular the differences over the prior art system of FIG. 1, is best explained by describing how alphanumeric data within a partition on the screen can be smoothly scrolled. Scrolling (vertical) is the action of moving alphanumeric or other information upwardly or downwardly on the screen. Generally in the past the characters have been moved row by row, that is in discrete jumps from one row to the next, but many believe that from a human factor's point of view smooth scrolling is preferable; the movement is less jumpy because it is effected on a scan-line by scan-line basis rather than on a row-by-row basis. Until now, scrolling within a partition on a screen has been on a row-by-row basis: the only smooth scrolling has been where the whole screen has been scrolled. Of course smooth scrolling of part of the screen is possible where the refresh buffer is an all-points-addressable bit-for-pel buffer. As will be seen, by employing a third row buffer, smooth scrolling can be accomplished within a partition using a regular character refresh buffer rather than a bit-for-pel buffer.

To load a row buffer 5, 6 or 15 from the refresh buffer 2, several line scan periods are required. However by using three row buffers, two rows of data may be accessed for refresh while still allowing one full row time for the third row buffer to be loaded. In essence, while refreshing one row of data, it is not the next row which is being loaded but the one after the next.

Figure 3:
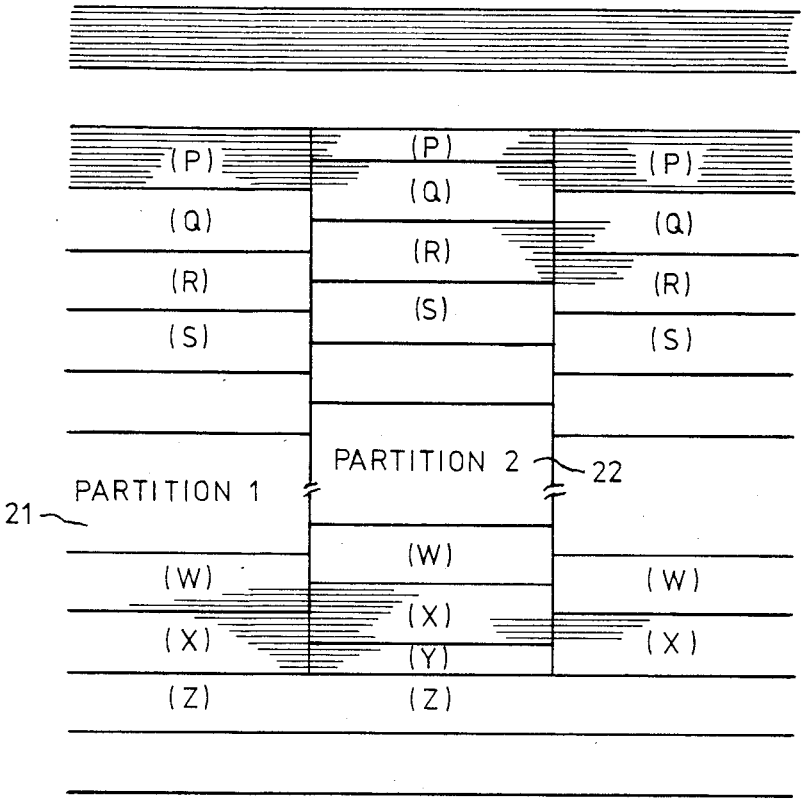
FIG. 3 illustrates how data within a partition can be smoothly scrolled upwardly.

FIG. 3 is a view of the CRT screen in which there are two partitions 21 and 22, the latter being surrounded by the former and being scrolled upwardly relative to it. As is indicated diagrammatically, the screen has a number of rows of data P, Q, R . . . W, X, Z, each row being formed as a number of raster scan lines. As shown in FIG. 3, the data in partition 22 has been scrolled upwardly by 5 scan lines so that part of row P has disappeared while part of a new row Y has appeared. In FIG. 3, at the start of the process, both rows P and Q were available in row buffers A and B (5 and 6), FIG. 2, while row R was being loaded into row buffer C (15). To scroll the partition 22, the controlling microprocessor or other control logic (not shown) will define the partition boundaries by loading appropriate timings within the CRT control module 20, FIG. 2. At the same time, the microprocessor (or other control logic) will load the number of scan lines the partition is to be offset into counter 18, FIG. 2. When the partition boundary is encountered during the raster scan, the control module 20 will recognize it and will cause the character generator 3 to be addressed by the offset slice counter 18 rather than by the slice counter 4. On leaving the partition, the addressing will be returned from the offset counter 11 to the slice counter 4.

On a particular scan line during the scanning of row P, if the offset is applied to the slice address such that the resulting value is greater than a full character row, the control module will select the next row of characters (row Q from row buffer B) within the scrolled partition, wrapping the slice address to the top of this row. As three row buffers are used there is no timing problem in selecting row Q from buffer B: in a two-row buffer arrangement, row Q might not have been fully loaded at the time it was required for refresh.

Eventually, scanning of row P will be complete and row buffer A can then be released to load character row S. Row Q (in row buffer B) will be accessed exclusively for a while, but offset in the partition 22, and then access will be row Q and row R during the scrolled partition.

The microprocessor (or other control logic) progressively increases the scroll offset within the offset counter 18, so causing the scrolled partition to move. When the offset equals a complete character row, the microprocessor re-orders its data pointers and the offset is re-set to zero.

A special situation arises at the bottom of the scrolled partition and occurs because once a partition is scrolled, an extra part of a row is visible, that is the partition scrolled will contain one more row than the rest of the screen as will be seen in FIG. 3. For the last few scan lines of row X, row Y has to be accessed during the scrolled partition. This is the extra row and is only used in the scrolled partition. At the end of row X, instead of proceeding to row Y for partition 21, the control logic 20 will skip the row buffer 5, 6 or 15 containing row Y and will access row Z in the appropriate row buffer 5, 6 or 15. The microprocessor will have ensured that row Z contains the correct data for the next row of partition 21.

The apparatus shown in FIG. 2 contains two slice counters 4 and 18 that can be used independently for different parts of the display screen. By using these in conjunction with the three row buffers 5, 6 and 15, characters of different heights (that is requiring different numbers of raster scan lines) can be displayed on the same horizontal row. The differently sized characters are contained within separate partitions on the display screen. Each slice counter, 4 or 18, is incremented at the end of each slice and independently reset when it reaches the value of the last slice for its respective character height.

When the characters are all of the same height (and there is no smooth scrolling as is described above), the row buffers 5, 6 and 15 are used sequentially for each row of characters. Thus for a particular row, row buffer 5 is being loaded while row buffer 6 is supplying characters and row buffer 15 is also available to supply characters (but is not required). To display the next character row on the display screen, row buffer 6 will be loaded, row buffer 15 will supply characters and row buffer 5 will also be available.

When the characters are of different height, the row buffers are loaded at the rate at which the smaller characters (that is those requiring fewer scan lines) are displayed. Therefore, once the last slice of the smaller character has been displayed, the row buffer that supplied it starts being loaded—say row buffer 5. The next row of characters is then supplied from the next row buffer (buffer 6 in this example). However at the time of the switch to row buffer 6, the larger characters on the row may not have been fully displayed. If they were being supplied from the same row buffer then these characters are also required to have been previously loaded into the new row buffer (buffer 6 in this example) so that these characters are still available when the row buffers are switched. However at the time of the switch of row buffers for the smaller characters, it is not always true that both the large and the small characters are being read from the same row buffer. When the last row of the larger characters has been displayed then the next row of larger characters is obtained from the next row buffer. Hence at the time of the switch for the smaller characters, the larger ones might already be coming from the next row buffer.

This technique will work independently of the ratio of the height of the smaller and larger characters. However the smaller the characters the greater the rate at which the row buffers have to be loaded and hence the greater the data rate that is required. Because two slice counters, 4 and 18, are used, two different sizes of characters can be displayed on the same row. By increasing the number of slice counters, a greater number of character heights can be displayed on the same row. It is not necessary to increase the number of row buffers since three are sufficient for any number of different character heights, since with one reserved for the characters of larger height in the row there are still two available for updating the display of the rows of smaller characters.

Figure 4:
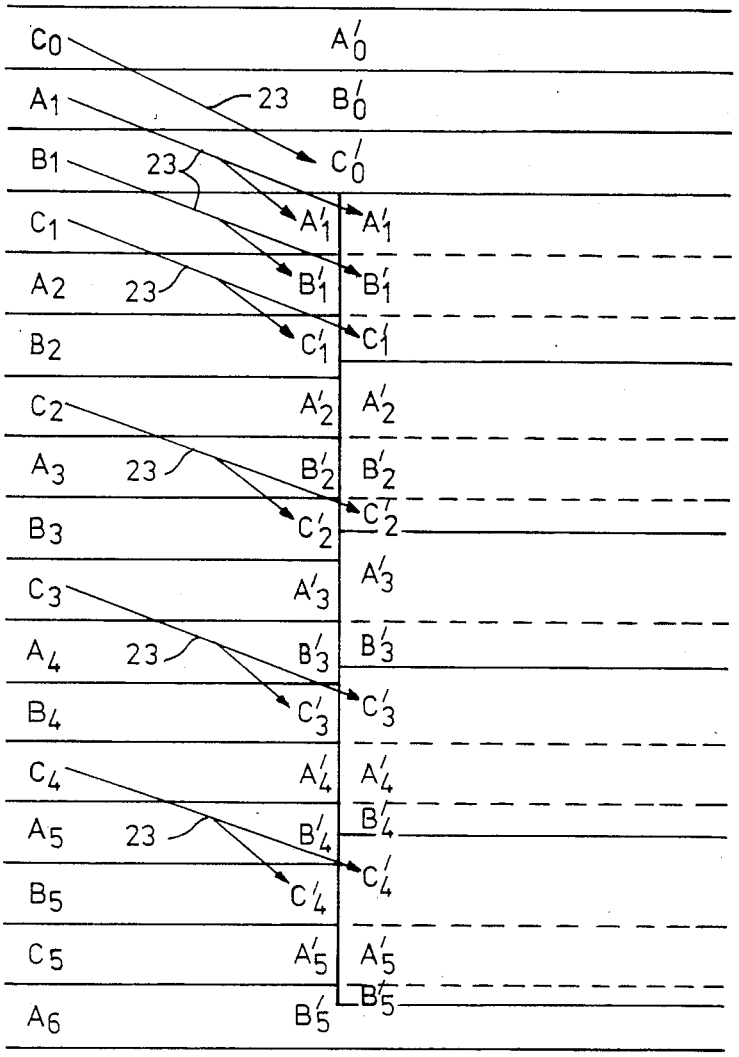
FIG. 4 illustrates how characters of different height can be displayed on the CRT screen.

FIG. 4 is an example of a display screen with two differently sized characters. It will be seen that the larger characters are just over 2½ times higher than the smaller characters. The letters A, B and C in FIG. 4 serve to show which of the row buffers 5, 6, 15 is being loaded while that character row is being displayed. The letters A', B' and C' show which row buffer 5, 6, 15 is supplying the character codes to the character generator 3 for display. It will be seen that a row buffer is loaded after it has been used to access the character generator; it will also be seen that character codes are required only after the corresponding row buffer has been loaded (as represented by the arrows 23). The slice counter 4 is used to obtain the slice bit patterns for the smaller character rows and the slice counter 18 is used for accessing the character generator for bit patterns for the larger character rows. The provision of further slice counters would allow more than two different sizes of characters to be displayed.

Although a display system in which characters of different height has been described, it will be evident that the mechanism can also be used to display characters with superscripts or subscripts. The invention's use of three row buffers enables the provision of a much improved display with better "human factor" characteristics.

Although the invention has been described in terms of a mapped refresh buffer, its principles are equally applicable to the use of an unmapped refresh buffer. Similarly, the invention is applicable to display systems employing attribute buffers in which the refresh buffer is enlarged or duplicated to carry character attributes which determine how the corresponding character is to be displayed (for example color, flashing, high intensity, etc). Clearly the row buffers will need to be enlarged to carry the associated attributes.

In a modification, the principles of the invention may be used to improve the scrolling performance of a bit-for-pel buffered display. A refresh buffer containing pointers (corresponding to the character codes) is used to address areas of the bit-for-pel refresh buffer (corresponding to the character generator ROS/RAM). Three buffers can be used to assemble the pointers to scroll the picture without the need to re-write the data in the bit-for-pel buffer.

We claim:

1. Data display apparatus for displaying data on the screen of a raster-scanned cathode ray tube (1) comprising a refresh buffer (2) adapted to contain character codes representing alphanumeric characters or other symbols to be displayed, a character generator (3) adapted to contain bit patterns corresponding to said characters or symbols to be supplied to said cathode ray tube, first and second character row buffers (5, 6) for storing successive rows of characters or symbols to be displayed on said cathode ray tube, and means (7 to 11 and 13) for loading character codes into one row buffer as another row buffer is addressing said character generator to access bit patterns therein, characterized in the provision of a third row buffer, (15), and means for causing either, or intermixedly, both of any two of the row buffers to access the character generator while the other of the three is being loaded from the refresh buffer whereby the bit pattern for a particular raster scan line can be derived by accessing said character generator by one or two of said row buffers.

2. Display apparatus as claimed in claim 1, comprising a slice counter (4) and an offset slice counter (18) and means (19, 20) for addressing said character generator under the control of said slice counter or said offset slice counter to derive bit patterns for a particular raster scan line in accordance with screen partition boundaries whereby data displayed within a partition can be vertically scrolled scan line by scan line.

3. Display apparatus as claimed in either preceding claim for displaying character sets of different heights comprising a plurality of slice counters (4,18) one for each character set height to be displayed, and means for causing each slice counter to be reset after the last slice of each character associated therewith has been displayed on said cathode ray tube.

4. A data display apparatus claimed in claim 1 or claim 2, in which the character generator is adapted to constitute a bit-for-pel buffer containing a bit pattern corresponding to pels to be displayed and in which the refresh buffer is adapted to contain pointers used to address areas in said bit-for-pel buffer whereby picture data can be scrolled using the refresh buffer and three row buffers without re-writing data within the bit-for-pel buffer.

5. A data display apparatus claimed in claim 3, in which the character generator is adapted to a data display apparatus claimed in claim 1 or claim 2, in in which the character generator is adapted to constitute a bit-for-pel buffer containing a bit pattern corresponding to pels to be displayed and in which the refresh buffer is adapted to contain pointers used to address areas in said bit-for-pel buffer whereby picture data can be scrolled using the refresh buffer and three row buffers without re-writing data within the bit-for-pel buffer.

* * * * *